United States Patent [19]

Puurunen

[11] 4,255,407

[45] Mar. 10, 1981

[54] METHOD FOR THE REGENERATION OF PICKLING ACIDS

[75] Inventor: Juhani E. Puurunen, Pori, Finland

[73] Assignee: Oy W. Rosenlaw Ab, Pori, Finland

[21] Appl. No.: 101,184

[22] Filed: Dec. 7, 1979

[30] Foreign Application Priority Data

Dec. 7, 1978 [FI] Finland ..... 783773

[51] Int. Cl.[3] ..... C01B 21/46

[52] U.S. Cl. ..... 423/390; 134/12; 134/13; 423/484; 423/DIG. 1

[58] Field of Search ..... 423/DIG. 1, 390, 484; 134/12, 13; 203/13, 96

[56] References Cited

U.S. PATENT DOCUMENTS

| | | | |
|---|---|---|---|
| 1,832,853 | 11/1931 | Bennet | 203/13 |
| 2,993,757 | 7/1961 | Dasher et al. | 423/391 X |
| 3,787,306 | 1/1974 | Senior et al. | 423/DIG. 1 |
| 3,840,646 | 10/1974 | Sugimoto et al. | 423/390 |

FOREIGN PATENT DOCUMENTS

| | | | |
|---|---|---|---|
| 1182834 | 12/1964 | Fed. Rep. of Germany | 423/557 |
| 46-20888 | 12/1971 | Japan | 423/390 |

*Primary Examiner*—G. O. Peters

*Attorney, Agent, or Firm*—James R. Laramie; Edward S. Irons

[57] ABSTRACT

A method for the regeneration of spent pickling acids. Said acid is mixed with such a minor quantity of a stronger acid that the losses of said stronger acid are compensated. The mixture obtained is stripped, whereby the weaker acids are vaporized. The vapor phase containing the weaker acids is passed to a condenser. The condensate obtained forms the regenerated pickling acid. The spent pickling acid can also be passed directly to an evaporator in which a solution containing a stronger acid is circulated. The vapor from the evaporator is passed to an absorption column and thereafter to a condenser, the regenerated acid being formed of the condensate from said condenser.

4 Claims, 1 Drawing Figure

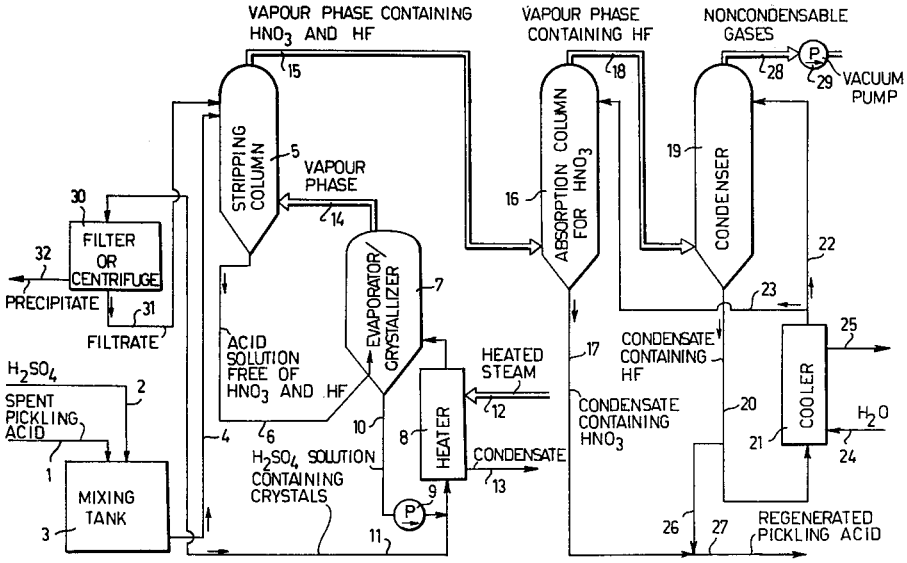

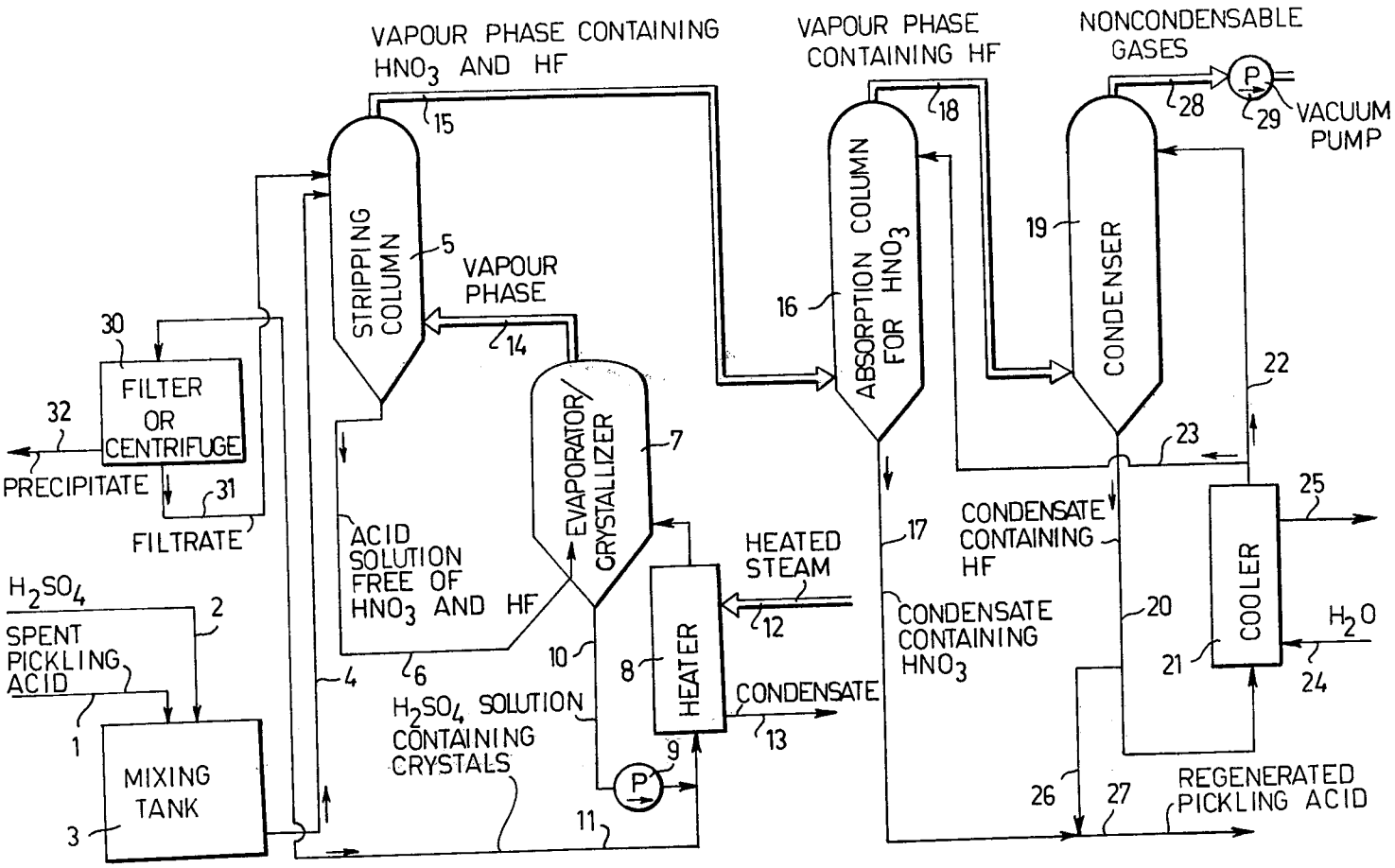
NONCONDENSABLE GASES
VACUUM PUMP
CONDENSER
COOLER
$H_2O$
REGENERATED PICKLING ACID
CONDENSATE CONTAINING HF
CONDENSATE CONTAINING $HNO_3$
VAPOUR PHASE CONTAINING HF
ABSORPTION COLUMN FOR $HNO_3$
HEATED STEAM
CONDENSATE
HEATER
EVAPORATOR/ CRYSTALLIZER
VAPOUR PHASE
VAPOUR PHASE CONTAINING $HNO_3$ AND HF
STRIPPING COLUMN
ACID SOLUTION FREE OF $HNO_3$ AND HF
$H_2SO_4$ SOLUTION CONTAINING CRYSTALS
FILTER OR CENTRIFUGE
FILTRATE
PRECIPITATE
$H_2SO_4$
SPENT PICKLING ACID
MIXING TANK

METHOD FOR THE REGENERATION OF PICKLING ACIDS

This invention relates to a method for the regeneration of spent pickling acids wherein, by using a stronger acid, for example, sulphuric acid, weaker acids, for example, nitric acid and hydrofluoric acid are brought into the vapour phase and are recovered by means of condensation.

When manufacturing refined steel plates, pipes, etc., as well as also, for example, titanium plates, a thin layer is removed from the metal surface by means of acid pickling. The reason to this is that, while treating the plate, its surface is partly oxidized and, on the other hand, the chrome content in the surface of refined steel is lower than inside the material. Generally, the pickling is carried out by using acid basins through which the steel plate is drawn as a continuous strip. The diluted acid mixture in the basin gradually looses its pickling effect and reaches a maximum metal content, whereafter the acid basin is emptied and fresh acid is fed instead.

The spent acid is nowadays commonly passed to neutralization wherein lime is used. The calcium fluoride or any other precipitate formed as a result of the neutralization is separated by means of a filter from the residual solution which is pumped into the watercourse. The residual solution contains, among other things, large quantities of nitrates. The lime-containing precipitate is conveyed to a dumping ground. In addition to the environmental problems caused by the neutralization, the disadvantages include the cost of the neutralization and the initial costs of the expensive pickling acids. By means of regenerating the spent acid, it is possible to achieve a result that is satisfactory both as far as environmental protection and economy are concerned. In this sense, in particular the regeneration of the mixture of nitric acid and hydrofluoric acid is of paramount importance. So far, however, no satisfactory solution to the problem has been found.

There are a number of patents relating to the regeneration of a spent pickling acid solution containing nitric acid. The Austrian Pat. No. 335 251 is based on a partial evaporation of the spent acid in a pipe heated by means of electric resistances whereby a portion of the nitric acid is brought into the vapour phase. The solution is passed onto crystallizers in which the metal fluorides are precipitated. After filtration, a portion of the nitric acid is still recovered and combined with the condensate in the evaporator. The method suffers from the disadvantage of a low degree of regeneration for acids, and as far as hydrofluoric acid is concerned, the degree of regeneration remains very low.

A mixture of nitric acid and hydrofluoric acid can also be recovered by using hydrometallurgical leaching. The method has been in use in Sweden, but now the operation has been discontinued. In the method, sulphuric acid is mixed with the pickling acid and, by using tributyl phosphate as medium, the metal sulphates are recovered separately, the sulphuric acid is recirculated and the pickling acid is regenerated. The method is complicated, expensive and difficult to use. The regeneration degrees obtained have remained low.

The U.S. Pat. No. 3,852,412 describes a method wherein an $HNO_3$ solution containing ferric nitrates is evaporated and distilled close to the $HNO_3$—$H_2O$ azeotrope. When continuing the distillation, pure nitric acid and ferric nitrate are obtained. The method is not applicable to the regeneration of mixed acids, and a part of the nitric acid remains unregenerated in nitrate form.

The German Pat. No. 2 332 858 describes a method wherein a mixture of nitric acid and hydrofluoric acid is first neutralized in a conventional way with $Ca(OH)_2$. Sulphuric acid is then added to the calcium nitrate solution obtained, whereby the calcium sulphate is precipitated and the nitric acid is regenerated. Neither this method is applicable to mixed acids, and it uses large amounts of sulphuric acids.

The U.S. Pat. No. 2,993,757 describes the use and evaporation under subatmospheric pressure of sulphuric acid for the regeneration of spent pickling acid. In the method, as much as possible of the liquid volume is first evaporated in a first evaporator, sulphuric acid is added and further evaporated in a second evaporator, whereby the pickling acids are brought into the vapour phase and recovered after condensation. The disadvantages of the method are its complexity and high price due to the fact that two evaporators are required as well as corrosion problems when regenerating mixed acids by means of heat exchangers.

The U.S. Pat. No. 3,840,646 describes a better method wherein sulphuric acid is directly mixed with spent pickling acid in such a quantity that the nitrate content of the acid is less than 0.2% by weight. The evaporation takes place in a 1-step evaporator under subatmospheric pressure. In the method, air is fed to the evaporator to provide a sufficient circulation of the solution through the heater. The method suffers from the disadvantage of requiring large air quantities that must be removed by a vacuum pump and of requiring a large quantity of circulating sulphuric acid in order to keep the nitrate content at a low level.

In the method according to the invention, it has been possible to eliminate the above-described disadvantages. In this method, the spent pickling acid solution is mixed with a small amount of a stronger acid, such as sulphuric acid. The amount of sulphuric acid corresponds to the amount entrained by the metal sulphates from the filters. A diluted acid solution is passed to a stripping column in which the acid solution at subatmospheric pressure first contacts a 60% sulphuric acid solution and thereafter steam flowing in counter-flow from an evaporator. The column is under sufficient subatmospheric pressure so as to evaporize the weaker acids and bring them into the vapour phase.

The mixture obtained from the bottom of the column now contains only small amounts of the weaker acids. On the other hand, the metal salts are in the sulphuric acid solution. The solution from the bottom can now be fed into an evaporator/crystallizer in which, for example, a 60% sulphuric acid content is maintained. The circulation is carried out by means of a centrifugal pump, and a graphite heat exchanger may be used as heater. The incoming solution is fed below the liquid surface in the evaporator, whereby the content of the weaker acids coming from the column sinks still further before their arrival at the heat surface of the heater.

The vapour from the evaporator is first conducted through the stripping column and subsequently the vapour containing the weaker acids is brough into an uncooled contact with the solution coming from the evaporator or with a portion thereof in a so-called absorption column. During the contact the main portion of the acid having a lower vapour pressure, for example, nitric acid, but only a minor portion of the acid having a higher vapour pressure, for example, hydrofluoric acid is absorbed in the solution from the evaporator.

The vapour from the absorption step is condensed entirely. Due to the low acid content, generally used materials can be used in the condenser.

In the evaporator/crystallizer, the metal salts are concentrated and precipitated as metal sulphates. The precipitate is separated by means of a filter or a centrifuge, and the obtained filrate comprising an about 60% sulphuric acid solution is recirculated through the stripping column to the evaporator.

According to a modification of the invention, the spent pickling acid is passed directly to the evaporator wherein a solution containing a stronger acid is circulating, and the vapour from the evaporator is passed to the absorption column in which the vapour contacts uncooled a portion of the condensate from the condenser and from which the vapour is passed to the evaporator, whereby a regenerated acid is formed from the condensate of the evaporator and the condensate that has passed through the absorption column.

To illustrate the idea of the invention, FIG. 1 shows the flow diagram of the method.

By way of example, the process for regenerating a pickling acid solution containing about 15% of $HNO_3$ and 5% of HF is described, the metal contents of said acid solution being, for example, Fe 30 g/l, Ni 6 g/l, Cr 6 g/l and molybden 1 g/l. The pickling acid solution is fed through pipe 1 to mixing tank 3 to which also the required sulphuric acid is dosaged through pipe 2. The mixture is fed through pipe 4 to stripping column 5 to the upper part of which also the filtrate containing sulphuric acid from filter or centrifuge 30 is fed through pipe 31. In column 5, the solutions fed in are contacted with vapour flow 14 from evaporator 7. Solution 6 coming from the bottom is nearly free of nitric acid and hydrofluoric acid. A solution containing sulphuric acid and metal sulphate crystals circulates through heater 8 in the evaporator via circulation pipe 10. The circulation is maintained by means of pump 9. Heating steam 12 is fed to the heater, and condensate 13 is removed therefrom. From the circulating solution, a flow of the solution containing crystals is continuously taken out through pipe 11 and pumped to the filter or centrifuge 30.

The vapour flow 14 from evaporator 7 passes through column 5, whereby the nitric acid and hydrofluoric acid are evaporated and pass to the flow 15. The vapour is passed to an absorption column 16 for nitric acid wherein the vapour contacts uncooled a portion of the condensate from condenser 19, said condensate being conducted through pipe 23. The vapour from column 16 is passed through pipe 18 to condenser 19 in which the vapour is entirely condensed into the circulating cooled solution. The circulating solution is passed through pipe 20 to cooler 21 and back to the condenser 19 through pipe 22. The cooling water is conducted to condenser 21 through pipe 24 and discharged through pipe 25.

Condensate is discharged from the condensate circulation through pipe 23 in the absorption column 16 and out through pipe 26. The flows coming through pipes 17 and 26 are combined and recirculated for re-use through pipe 27.

By means of the filter or centrifuge 30, the precipitate is separated from the solution containing crystals from pipe 11 and passed through pipe 32 for further processing. The filtrate is passed through pipe 31 to column 5. The noncondensable gases are passed from evaporator 19 through pipe 28 to a vacuum pump.

The evaporation takes place in an about 60% sulphuric acid solution. The temperature of the circulating liquid is about 80° C., and the temperature in the evaporator is 0.1 bar. The crystal content in the evaporator is maintained at suitable level in order to obtain a sufficient crystal size. From the condenser 19, about half of the condensate is conducted through the column 16, whereby the nitric acid content in the flow is about 25–30% and the hydrofluoric acid content in the flow is about 10%. The combined flow 27 contains nearly 15% of nitric acid and about 5% of hydrofluoric acid. The temperature of the condensates is about 35° C.

The given numerical values concern only the embodiment in question. The method is applicable in any concentration to all pickling acids in which a weaker acid can be evaporated with a stronger acid. Thus, the embodiment shown does not comprise the entire scope of the method that is the object of the application.

The special characteristics of the method described are:

(1) use of reinforced plastics, teflon, graphite and other corrosion resistant structural materials so as to make the equipment durable, (2) stripping of the pickling acids before the evaporator so as to minimize the concentration of nitric acid in the evaporator, (3) feeding of condensate to the absorption column wherein the nitric acid is substantially absorbed owing to which generally used materials resisting a weak acid mixture can be used in the condenser, and (4) high regeneration degrees owing to the physical principle of the method.

As advantages of the method shall, moreover, be mentioned the low initial costs and low operating costs. Thus, the entire economy will be very advantageous. As far as environmental protection is concerned, the method according to the invention offers an optimal solution when considering that the metal sulphate precipitate can be further processed so as to recover the sulphate as sulphuric acid and the metals, for example, as oxides for recirculation of the manufacturing process.

What I claim is:

1. A method for the regeneration of spent pickling acids selected from the group consisting of nitric acid, hydrofluoric acid and mixtures thereof, characterized in that the spent pickling acid is mixed with such a minor quantity of sulphuric acid that the acid removed with the precipitate and any other acid losses are compensated, the mixture obtained is passed to a stripping column (5) in which the mixture comes into contact with steam from an evaporator/crystallizer (7) and the filtrate from a filter or centrifuge (30); whereby the weaker acids are brought into the vapour phase which is passed to a condenser (19), the liquid phase from the stripping column is passed to said evaporator/crystallizer in which the metals are concentrated and from which the vapour obtained is passed through said stripping column to said condenser, the condensate (20) obtained from said condenser forms the regenerated pickling acid, the liquid phase from said evaporator/crystallizer is passed to said filter or centrifuge in which the precipitate is separated, and the filtrate obtained is passed to said stripping column.

2. A method as claimed in claim 1, characterized in that the vapour phase obtained from the stripping column is passed to an absorption column (16) in which the vapour substantially uncooled contacts a portion of the condensate from the condenser, whereby of the acids in the vapour phase, a substantial portion of the acid with the lowest vapour pressure is absorbed, and the condensate from the absorption column is combined with the condensate from the condenser, whereby a regenerated acid is formed.

3. A method as claimed in claim 1, characterized in that the spent pickling acid containing nitric acid and hydrofluoric acid is mixed with sulphuric acid in a quantity according to the material balance, the mixture obtained is passed to the stripping column wherein the mixture contacts the vapour from the evaporator/crystallizer and the filtrate from the filter or centrifuge (30) whereby the nitric acid and the hydrofluoric acid are transferred to the vapour phase, the liquid phase from the stripping column is passed to the evaporator/crystallizer in which the metals entrained into the liquid phase are concentrated as sulphates, the vapour phase from the evaporator/crystallizer is passed through the stripping column to the absorption column for nitric acid in which the vapour substantially uncooled contacts a portion of the condensate from the condenser, whereby a substantial portion of the nitric acid is absorbed in the condensate, the vapour from the absorption column is condensed, whereby the hydrofluoric acid is nearly entirely condensed, that the regenerated acid is formed by combining the condensates obtained.

4. A method for the regeneration of spent pickling acids selected from the group consisting of nitric acid, hydrofluoric acid and mixtures thereof, characterized in that the spent pickling acid is passed directly to the evaporator (7) in which a solution containing sulphuric acid is circulated, and the vapour from the evaporator is passed to the absorption column (16) in which the uncooled vapour contacts a portion of the condensate from the evaporator and from which the vapour is passed to the condenser (19), the regenerated acid being formed of the condensate from said condenser and the condensate that has passed through the absorption column.

* * * * *